United States Patent [19]

Glover

[11] 4,018,557

[45] Apr. 19, 1977

[54] METHOD FOR TRANSFER COLOR PRINTING

[76] Inventor: Richard Donovan Glover, Ings Mills, Dale St., Ossett, Yorkshire, England

[22] Filed: July 2, 1975

[21] Appl. No.: 592,552

Related U.S. Application Data

[62] Division of Ser. No. 422,093, Dec. 5, 1973, abandoned.

[30] Foreign Application Priority Data

| | | |
|---|---|---|
| Dec. 6, 1972 | United Kingdom | 56189/72 |
| Dec. 12, 1972 | United Kingdom | 57304/72 |
| Dec. 12, 1972 | United Kingdom | 57306/72 |

[52] U.S. Cl. ..... 8/1 XB; 8/2.5 A; 28/74 P; 101/470; 156/238; 156/277

[51] Int. Cl.[2] ..... D06P 7/00; B41M 5/26

[58] Field of Search ..... 101/470; 8/2.5 A, 1 XB; 28/74 P; 156/238, 277

[56] References Cited

UNITED STATES PATENTS

| | | | |
|---|---|---|---|
| 83,103 | 10/1868 | Stephens | 101/172 |
| 627,329 | 6/1899 | Dratz | 101/131 |
| 1,739,322 | 12/1929 | Moore | 156/254 |
| 2,477,300 | 7/1949 | Karfiol et al. | 428/142 |
| 3,533,871 | 10/1970 | Zentmyer | 28/72 P |
| 3,723,213 | 3/1973 | Hoey | 156/72 |
| 3,751,778 | 8/1973 | Grosjean et al. | 8/17 |

FOREIGN PATENTS OR APPLICATIONS

| | | | |
|---|---|---|---|
| 232,082 | 1/1961 | Australia | 8/14 |
| 1,189,026 | 4/1970 | United Kingdom | |

OTHER PUBLICATIONS

"Transfer," Textile World, Feb. 1972, pp. 50 and 52, Transfer Pringing: Ready to Challenge for the Volume Lead.

*Primary Examiner*—Clyde I. Coughenour
*Attorney, Agent, or Firm*—Wolf, Greenfield & Sacks

[57] ABSTRACT

A method for the color printing of yarns in a space-dyed pattern so that the yarns can be used in a process to form the pile of a fabric, and form a color pattern in the fabric said method comprising printing a pattern of parallel color strips on a transfer sheet using sublimatic dyestuffs, and then causing, by the application of heat, release of said dyestuffs from the sheet, whilst the sheet is in face to face contact with a bank of parallel yarns. It is preferred that an air flow through the yarns be created during the dyestuff release so as to draw the vapor phase dyestuffs into and round the yarns.

3 Claims, 9 Drawing Figures

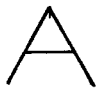
FIG. 1
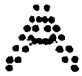
FIG. 3
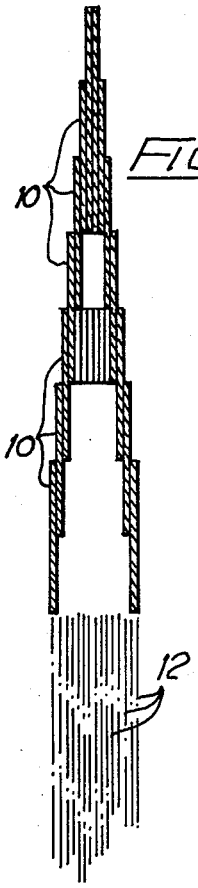
FIG. 2
FIG. 4
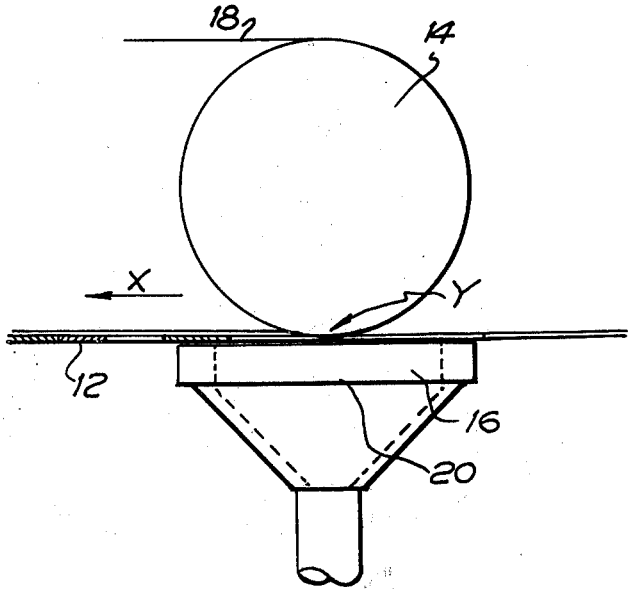

METHOD FOR TRANSFER COLOR PRINTING

This is a division of application Ser. No. 422,093, filed Dec. 5, 1973, now abandoned.

This invention relates to a method of colour printing using yarns, a printed sheet for use in the method, and to an apparatus for use in the method.

The invention is concerned with the "space dyeing" of yarns whereby the yarns may be used subsequently in tufting apparatus to produce, or may form the pile fabric of a carpet or rug having a colour pattern therein formed by the particular spaced dyeing of the yarns.

A number of spaced dyeing processes are already known as is the desirability of space dyeing yarns. In particular, the space dyeing of yarns is an attempt to enable the use of yarns to produce carpet piles having a coloured pattern of a nature which is conventionally achieved only by Axminster and Wilton weaving processes, without using any such weaving processes.

One recently proposed method for the space dyeing of yarns, comprises feeding the yarns in turn through a bank of roller pairs, each roller pair being associated with dye of a particular colour. The roller peripheries are defined by rings of pads individually mounted on plungers and when dye is to be applied to an individual yarn as it passes between a pair of plungers these plungers are moved together to apply the dye to the yarn. Following application of dye, the yarns require steaming, washing and drying before being wound on beams from which the yarns will be subsequently drawn to tufting apparatus. Such apparatus must of necessity be difficult to manufacture and expensive to produce. Furthermore, it is limited in the number of roller pairs which it can accommodate, and therefore the number of colours which can be applied to the yarns.

With the present invention I aim to provide a method of space dyeing yarns which is simple in principle and can be carried out by simple, robust apparatus.

According to one aspect of the present invention there is provided a method of space dyeing yarns which have an affinity for sublimatic dyestuffs, comprising heating a transfer printing sheet having printed therein in sublimatic dyestuffs the space dyed pattern to be recreated on the yarns whilst in contact with the yarns, to release the dyestuff from the transfer printing sheet and cause the dye to deposit on the yarns in said pattern.

The yarns preferably are arranged in parallel disposition whilst being printed, the said printing on the transfer sheet being arranged in parallel strips.

The yarns may be fed past a printing station. The yarns may be fed in a step-by-step fashion or in a continuous fashion. The printing sheet may be a continuous, rolled sheet.

The transfer sheet is preferably applied to one side only of the yarns, and across the yarns is applied a pressure thereby create an air flow to draw dyestuff in the vapour phase into and around the yarns to effect an even dyeing thereof.

Where process operates on a continuous basis, and the transfer sheet is in continuous web form, the said air flow can be created by applying a vacuum to the side of said yarns opposite said sheet.

The creation of a vacuum in this manner generates the pressure differential across the thickness of the yarns thereby inducing the dyestuff to travel downwardly as it is released from the carrier sheet. The said air flow can be created or assisted by blowing air through the sheet and yarns.

In a practical arrangement, a heated roller would be used to guide the transfer sheet in its travel to the yarns and the roller would also be used to press the transfer sheet and yarns together during the dyeing operation. A base platen structure supported against the roller could form the other side of a nip for the transfer sheet and yarns and the said platen structure could be adapted to enable the application of the vacuum through the platen structure to the yarns. To this end the platen structure may be a grid plate under which there is a vacuum chamber.

In making a yarn bonded carpet, a plurality of parallel yarns are carried by a carrier sheet, usually of paper, which is capable of being folded to corrugated form. The paper whilst carrying the yarns is corrugated by suitable apparatus such an intermeshing gearwheels, so that the corrugations extend in a direction normal to the length direction of the yarns and the yarns form loops in the corrugations. To form the carpet, a moldable or bondable medium, or medium faced backing sheet is applied to the yarn side of the corrugated sheet so that the yarns, in the vicinity between adjacent loops bond to the sheet and upon setting of such medium, become anchored thereto. The paper is then removed leaving a looped pile yarn bonded carpet.

Sometimes, the pile is made twice the required pile height and the looped top ends of the piles are bonded to another similar backing sheet, the yarns extending between and being anchored to each of said sheets. Two carpet lengths or carpets (having cut pile) can be formed by slitting the yarn lengths extending between the backing sheets, at their said points.

A disadvantage of this carpet is that for it to have a coloured pattern of Wilton standard it must be printed after it has been completed, unless space dyed yarns are used. Yarns space dyed according to the method as aforesaid can be used for this purpose, and according to a preferred feature of this invention, simultaneously with the printing, the transfer sheet and yarns are shaped into corrugated form, the corrugations extending in a direction normal to the yarn lengths.

Generally speaking, if a loop of yarn in a corrugation is to be dyed, it will be dyed all the same colour, but this is not necessary in all cases, for example the top half of a loop may be in one colour whilst the bottom half is in a different colour in the case where two yarn bonded carpets are to be produced from a single set of corrugated or looped yarns, in which case the upper and lower sections of each loop, of yarn are separated by a subsequent cutting action.

The method according to the invention it will be appreciated provides considerable flexibility in the selection of colours to be applied to the yarn because the colours are applied to the transfer sheet at a separated printing process which may of course be conventional. The printing of the transfer sheet may for example be by silk screen printing, gravure, litho or offset. Where the yarns are to be used for tufting preferably the paper will be printed with a repeating pattern so that the yarns will be similarly printed with a repeating pattern.

According to another aspect of the invention, there is provided a transfer sheet for use in the sublimatic printing to space dye parallel yarns for the production of a pile fabric having a colour pattern, wherein the transfer sheet is printed with sublimatic dyestuff in a colour pattern made up of a number of parallel colour strips all of a length which is equal to or a whole number of times a module length corresponding to the height of the pile in the fabric to be produced using yarns dyed with the transfer sheet.

The strips may be of the same colour where only a two colour dyed fabric is required, but more usually will be of differing colours for the producing of multi-colour patterned fabrics.

In effect the said strips on the sheet will define the required finished patterns but it will be distorted in the direction of the length of the strips by the ratio of the yarn diameter to the required pile height.

If the yarns are held spaced apart by a pre-determined amount during dyeing, which would appear to have merit to prevent dye from one strip being applied to other than the proper yarn, then the strips will require to be pitched accordingly and this might result in a slight lateral distortion of the pattern on the printed sheet as compared with the final pattern to be produced in the finished fabric.

The transfer sheet may simply be a sheet of paper or a web of paper; other materials can be used.

An apparatus for carrying out the method of the present invention may be quite simple and comprise means for heating the transfer sheet to release the dyestuff and means for feeding the transfer sheet and yarns past heating means whilst the yarns are held in spaced parallel relationship.

Embodiments of the present invention will now be described by way of example with reference to the accompanying drawings, wherein:

FIG. 1 illustrates simply the letter A to be reproduced in a tufted carpet;

FIG. 2 illustrates how the transfer sheet would be printed for the subsequent printing of the yarns in order to recreate the said letter A in the tufted carpet;

FIG. 3 illustrates how the letter A would appear in the finished carpet;

FIG. 4 is a diagrammatic cross sectional view of machinery for use in carrying out the process of one embodiment of the invention;

Figure 5:
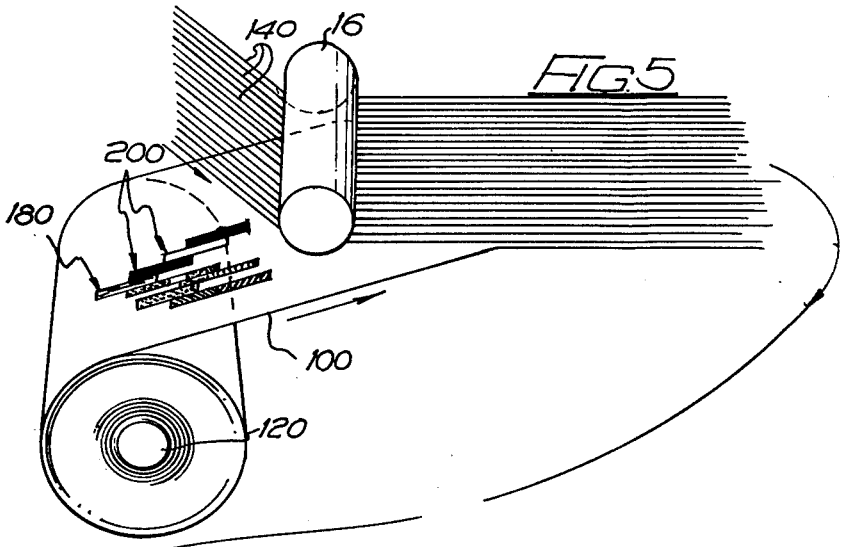
Figure 6:
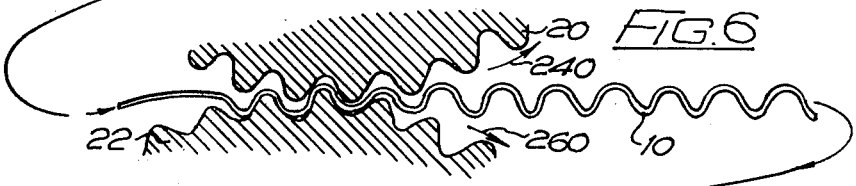
Figure 7:
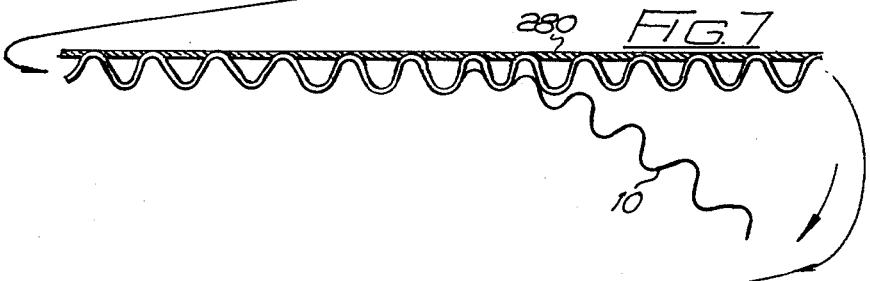
Figure 8:
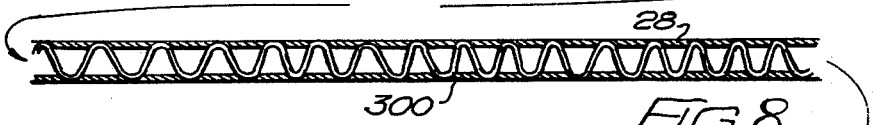
Figure 9:
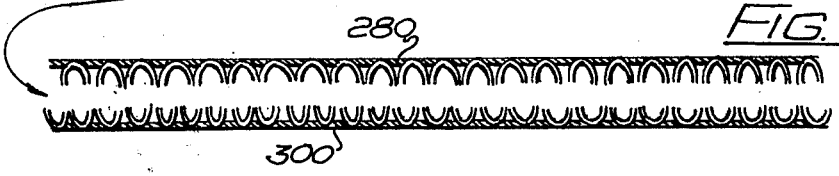

FIGS. 5 to 9 respectively show, in diagrammatic form, the stages involved in the transfer printing of yarns according to a second embodiment of the invention, FIGS. 7, 8 and 9, showing the stages involved in the production of a yarn bonded carpet.

Referring to the drawings, and firstly to FIGS. 1 to 4, assume that it is desired to create the letter A in a particular colour in a tufted carpet. In the method according to this embodiment it is necessary to recreate this letter A on a printed transfer sheet, and for the yarns which will make up the letter A in the finished carpet to be dyed in accordance with the pattern on the transfer sheet.

If it is assumed that the tufting apparatus is designed to operate at 8 tufts per inch and the pile is to be ½inch high, then the dimensions on the transfer sheet of the letter A of FIG. 1 from the top to bottom, assuming that the A is required in that disposition in the finished carpet, must be increased 8 times. FIG. 2 shows how the pattern to recreate the letter A would appear on the transfer sheet and it will be noticed that this pattern is made up of parallel strips 10 which extend in the direction of travel of the yarn indicated in FIG. 2 by numeral 12. The direction of travel is indicated by arrow X in FIG. 4 Thus, the transfer sheet and the yarns 12 travel in the direction of the length of the yarns 12, i.e. direction arrow X in FIG. 4.

When the transfer sheet and yarns are brought together at a heating zone pressure is applied to press the transfer sheet firmly to the yarns and simultaneously an air pressure differential is applied across the yarns by applying to the yarns, a partial vacuum. During this operation the dyestuff is released from the transfer sheet in the pattern as indicated in FIG. 2 and is applied to the individual yarns 12 in alignment with the strips 10 and in the pattern illustrated in FIG. 2. The provision of the vacuum to the underside of the yarns assists in the penetration of the dyestuff into the yarns and around the yarns so that even dyeing takes place.

After the printing, the transfer sheet is removed from the yarns leaving the yarns appropriately space dyed.

Subsequent tufting of the sections of yarn dyed in the pattern as illustrated in FIG. 2 recreates in the tufted carpet the letter A as shown in FIG. 3. It is to be noted that for the particular pattern shown in FIG. 3, the finished carpet has a cut pile, but the invention can be applied to the construction of carpets having a looped pile.

It is to be appreciated that the recreation of the letter A in the tufted carpet as shown in FIG. 3 is given by way of example and it is furthermore to be appreciated that with the process of this embodiment of the present invention, the printing of a large number of colours simultaneously and continuously can take place, and automatically in the tufting operation the appropriate pattern will be recreated. It is appreciated that the transfer sheets, which also form part of this invention will have to be printed in a pattern which is basically distorted in dependence upon the length of the finished tuft required in the carpet and also in the number of stitches per inch with which will be effected by the subsequent tufting apparatus. The distortion of the pattern however is only in the direction of travel of the yarns as indicated clearly in FIG. 2.

The apparatus shown diagrammatically in FIG. 4 comprises basically a heated cylinder 14 (any heating such as steam heating, infra red heating or electric heating may be used) and a lower platen structure 16. The transfer sheet 18 is fed round the cylinder 14 or could be fed in with the yarns 12 if desired but the yarns and sheet 18 are pressed together between the platen structure 16 and cylinder 14 at zone Y and simultaneously a partial vacuum is created with a cavity 20 centrally located in the pattern structure 16 so that such partial vacuum will be applied to the underside of the yarns for the purposes as aforesaid. The means for creating the partial vacuum are not shown, but may be conventional.

In addition to, or as an alternative to the application of the vacuum, air may be blown through the transfer sheet and yarns to assist or create the air pressure differential across the yarns. To this end the interior of the drum 14 may be pressurised, and the drum shell formed of a permeable sintered material. An internal shell could be used to ensure that air passes through the shell only at the region where the yarns and sheet are nipped together between the drum 14 and the platen structure 16.

Referring now to the FIGS. 5 to 9 of the drawings, in a first stage in the manufacture of twin, yarn bonded carpet, a roll of transfer printing sheet 100 is fed from a spindle 120 and meets a travelling web of yarns 140 disposed in parallel relationship. The yarns 140 may be guided by means of an idler roller 160 as shown to bring the yarns into face to face contact with the transfer printing sheet 100.

According to this embodiment of the present invention, the carrier sheet 100 is transfer printed with sublimatic dyestuff for example as indicated at 180 in order to space dye the yarns 140 in a subsequent printing step. It is to be noticed that basically the printing 180 for the space dyeing is made up of a number of parallel strips 200 of dyestuffs of differing colours for the recreation of a particular colour pattern in the finished carpets, in a manner similar to that described with reference to FIG. 2. The strips are based upon a modular length which is the pile height required in the final carpet. Each strip of dyestuff is one, two or more times the said modular length, and the length direction of the strips in relation to the carrier sheet 100 is such that these strips will extend in the direction of the yarns 140 when the yarns are placed in contact with sheet 100. Furthermore, the sidewise displacement of the strips 200 must be equal exactly to the spacing between the yarns 140 in order that the dyed strips will register with the yarns.

It is to be appreciated that the printed pattern on web 100 will normally repeat as is the usual case in a woven carpet with a pattern in colour and for example produced by an Axminster or Wilton process.

The sandwich of yarns 140 and transfer printing sheet 100 is fed between a pair of gearwheels 200, 220 (see FIG. 6) which are rotated as indicated by arrows 240 and 260. Feeding the sandwich between these gearwheels causes the formation of transverse corrugations in the paper sheet 100 and also causes the yarns 140 to follow the line of these corrugations and in effect become looped as shown.

Simultaneously with the formation of the corrugations the sandwich is heated by the gearwheels 200 and 220 which are in themselves heated by any suitable means in order to cause release of the sublimatic dye from the transfer sheet.

In this example, all the loops which are dyed by this process each is dyed in a single colour as shown in FIG. 6.

FIGS. 7, 8 and 9 show conventional stages of the process for forming bonded carpet, and in FIG. 7, a backing sheet 280 is applied to the corrugated sandwich to the yarn side to cause the yarns as indicated to adhere to the said backing sheet 280, and the paper 100 is then removed.

Another backing sheet 300 is applied as shown in FIG. 8 and the yarns become anchored to both sheets and extend between the sheets. Finally, severing of the yarn lengths joining the sheets 280, 300, produces two cut pile yarn bonded carpets, with the difference that these carpets when reaching this stage are already provided with a colour pattern of complexity equal to that normally achievable only with a Wilton or Axminster process.

The process may be stopped at the stage shown in FIG. 7 where the yarn loop height formed by the corrugation is equal to the pile height. These loops may be severed to produce a cut pile yarn bonded carpet if desired. Any number of yarns may be space dyed simultaneously be the methods according to the invention dependent of course upon the maximum width of printed transfer sheet 18 or 180. If it is desired to create a wide pattern which is wider than the maximum width of transfer sheet 18 or 180 then of course two or more sheets 18 or 180 may be used side by side relationship.

The yarns 12 or 140 may be located closely side by side or for better resolution may be spaced further apart. The spacing of the yarns further apart during the dyeing process simplifies the printing but of course reduces the amount of the pattern which can be accommodated within any fixed size of transfer sheet.

Continuous processes have been illustrated in FIGS. 4 and 6, but it is to be appreciated that this invention can be applied on a cycle basis i.e. by applying dyestuff to a section of yarns and using a transfer printing sheet then moving the section out of the heating zone and then applying dyestuff from a fresh transfer sheet to the freshly introduced section. In this connection, apparatus operating on a reciprocation basis as opposed to a rotary basis could be employed.

It is possible, in accordance with the present invention, to use two transfer printing sheets of which the printed patterns are mirror images one of the other, in which case, the yarns would be located between the transfer sheet, with such sheet arranged with the printing face to face and in exact pattern register, so that the yarns are dyed simultaneously from two sides.

In the sublimatic printing step, the temperature, pressure and duration will depend upon, the material of the yarns, the dyestuffs used and other parameters. It is well known in sublimatic printing that these parameters require to be varied, often by trial and error, to achieve the best results.

I claim:

1. A method of making a patterned pile fabric from yarns having an affinity for sublimatic dyestuffs, comprising the steps of 1. depositing the sublimatic dyestuffs in parallel strips on a transfer sheet whereby each deposited strip is located in relation to the other strips on the transfer sheet in accordance with the pattern to be produced in the pile fabric and has a length equal to or a whole number of times a modular length corresponding to the height of the pile of the fabric,
2. disposing the yarns in parallel relation at a dyeing station to cause the yarns to register with the parallel strips on the transfer sheet,
3. heating the transfer sheet to cause the dyestuffs to sublimate at the dyeing station, and
4. producing a differential pressure to draw the sublimated dyestuffs into and around the yarns to effect an even dyeing of the yarns.

2. The method according to claim 1, further including the steps of 5. causing the dyed yarns to be shaped into corrugated form with the height of the loops formed by the corrugations being equal to or an integral multiple of the modular length, and
6. bonding the ridges of the corrugated yarns to a backing sheet.

3. The method according to claim 2, further including the steps of 7. bonding the opposite ridges of the corrugated yarns to a second backing sheet, and
8. severing the yarns between the two backing sheets.

* * * * *